United States Patent [19]

Bakker

[11] 4,445,743

[45] May 1, 1984

[54] QUICK DISCONNECT CONNECTOR WITH POSITIVE LOCKING DEVICE

[75] Inventor: Willem F. Bakker, Wyoming, Ill.

[73] Assignee: Breeze Illinois, Incorporated, Wyoming, Ill.

[21] Appl. No.: 64,780

[22] Filed: Aug. 8, 1979

[51] Int. Cl.[3] ..... H01R 13/625

[52] U.S. Cl. ..... 339/90 R; 339/89 M

[58] Field of Search ..... 339/88–90; 285/89, 161, 361, 396, 402

[56] References Cited

U.S. PATENT DOCUMENTS 1,304,075 5/1919 Lofgarn ..... 339/90 R 2,400,351 5/1946 Hart ..... 285/89 X 2,998,588 8/1961 Chamberlain ..... 339/90 R

*Primary Examiner*—Eugene F. Desmond

*Attorney, Agent, or Firm*—Charles F. Pigott, Jr.

[57] ABSTRACT

The disclosed invention improves upon electrical connectors that when mated together provide electrical continuity across the connectors, and that are held mated together by bayonet locking means. A sleeve element is threaded onto an exterior portion of one of the connectors and bottomed upon rotation against the opposite connector and/or support structure for the opposite connector. This bottomed sleeve element maintains the bayonet locking means engaged, and thereby prevents accidental disengagement of the connectors.

4 Claims, 4 Drawing Figures

FIG. 1
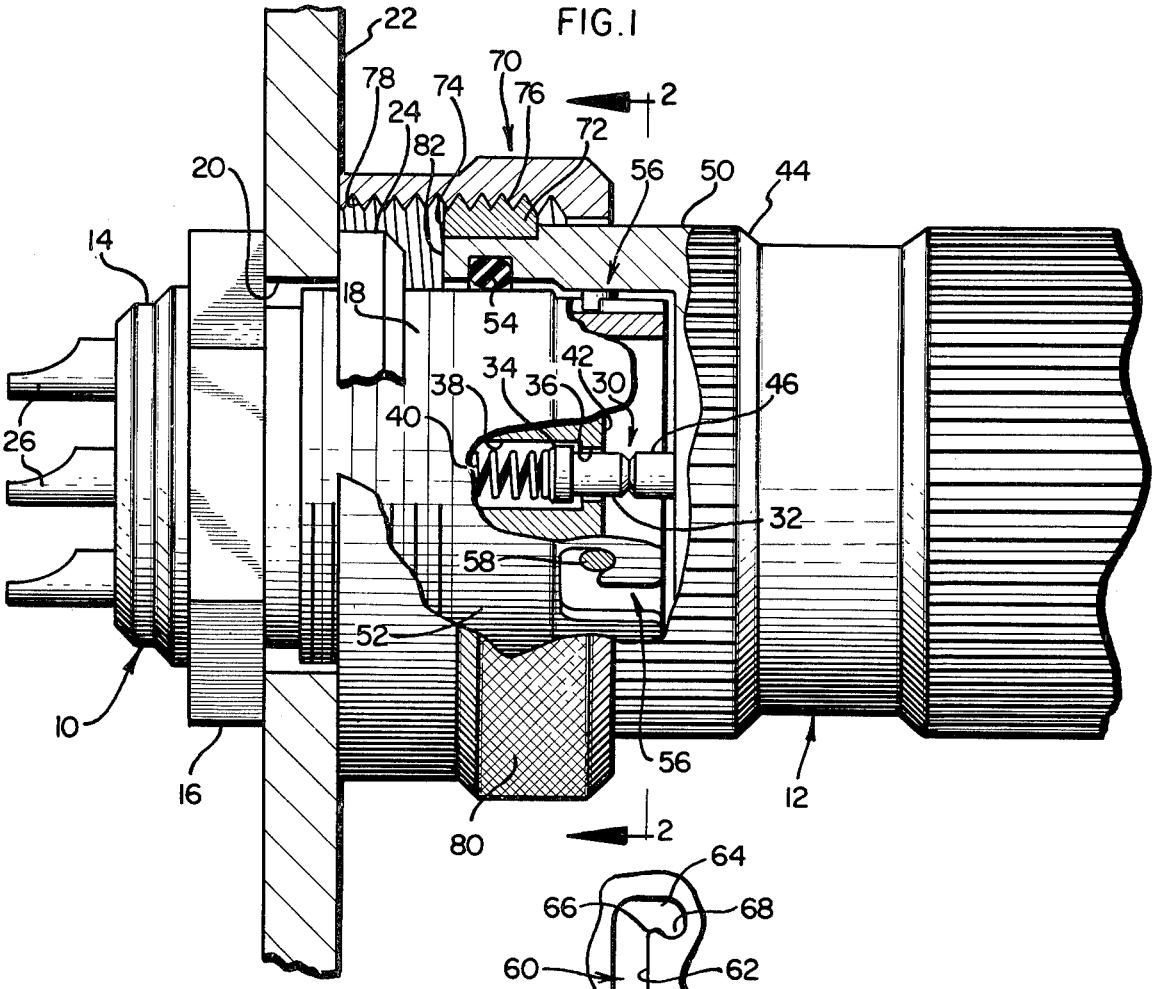
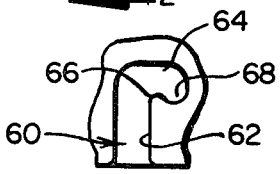
FIG. 2
FIG. 3
FIG. 4
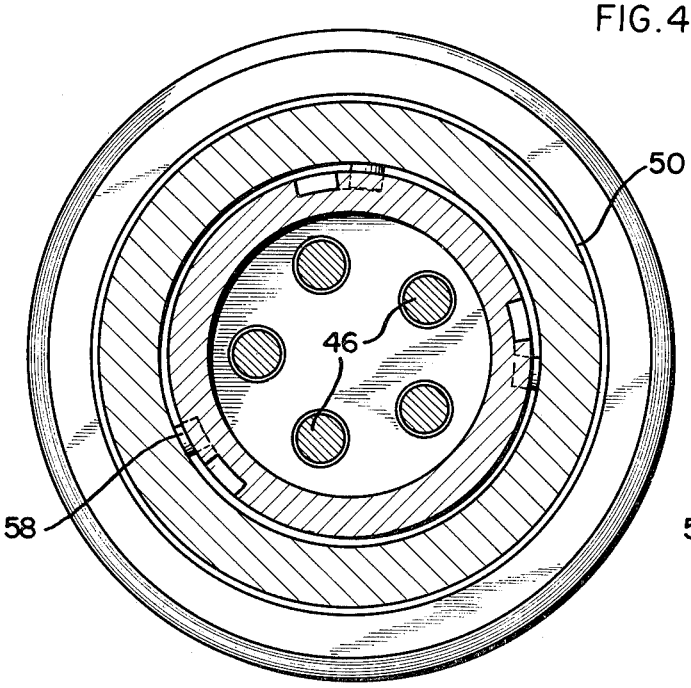
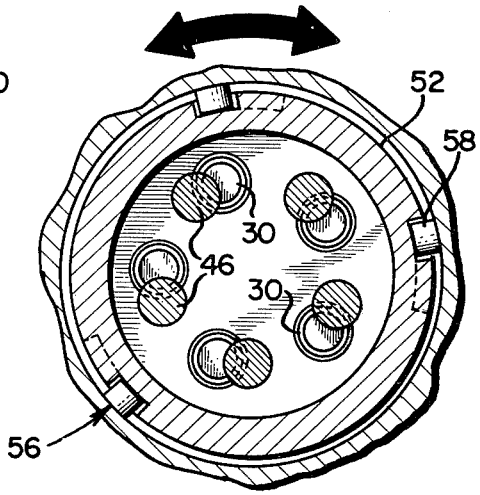

QUICK DISCONNECT CONNECTOR WITH POSITIVE LOCKING DEVICE

BACKGROUND OF THE INVENTION

Connectors are commonly used in electrical transmission equipment as a means of providing separable connections between components or breaks in the conducting cable or line. The connectors typically have appropriately arranged spring-loaded contacts which line up with and engage one another when the connectors are mated together to establish electrical continuity across the connectors. The connectors are frequently held together by a bayonet lock arrangement including spaced J-grooves having axial and transverse recess portions formed in one of the connectors and radially inwardly extending locking pins or projections formed on the other connector. The locking pins are initially fitted in the axial recesses of the J-grooves and the connectors are moved axially against one another compressing the spring-loaded contacts in one connector to bring the pins to the transverse recesses, and the connectors are then rotated relative to one another to move the locking pins along the transverse recesses. A slight detent hump in the transverse recess portion of each J-groove forms a seating area for the pin spaced remotely of the axial recess and the locking pins are each biased into such a corresponding seating area by the spring-loaded contacts.

The advantage of the foregoing known connector and lock arrangement is that it is easily assembled but a frequently experienced problem is that the connectors can unintentionally become disconnected. This is particular true where the contacts on one of the connectors are spring biased and serve as the sole means for maintaining the bayonet lock secured.

SUMMARY OF THE INVENTION

This invention relates to mating connectors of the type that are initially secured together with a bayonet lock, and provides for a secondary element threaded onto one of the connectors and rotated relative thereto to a positive locking position abutted tightly against the second connector and/or support structure for said second connector. The invention specifically provides for a secondary sleeve element having internal threads which cooperate with external threads formed angularly of one connector. The sleeve element can thus be rotated relative to the one connector to bottom against or relative to the other connector thereby positively holding the cooperating bayonet locking pins trapped in the seating areas of the J-grooves to prevent accidental release of the connectors. Thus, a positive lock is provided, in contrast with reliance on depressed spring-loaded contacts which maintain the connectors in locked relation in the known devices.

BRIEF DESCRIPTION OF THE DRAWINGS

FIG. 1 is a side elevational view, partly in section, of a pair of mating connectors showing a preferred embodiment of the subject invention;

FIG. 2 is a sectional view, as seen generally from line 2—2 in FIG. 1, showing the connectors in the engaged and locked position;

FIG. 3 is a fragmentary view similar to FIG. 2 except showing the connectors in a released position although still almost fully telescoped relative to one another; and FIG. 4 is a development type view of a typical bayonet J-groove, showing the axial and transverse recesses thereof.

DETAILED DESCRIPTION OF THE INVENTION

In FIG. 1, there is illustrated a quick-disconnect connector comprising a plug member 10 and a mating receptacle 12 shown secured together in electrical circuit transmitting capacity. The plug 10 has a housing 14 which includes a radial shoulder 16 and a threaded stem 18, the housing stem being fitted through an opening 20 in a panel 22 until abutted against the shoulder 16. A locking nut 24 is threaded onto the stem 18 and against the panel 20. The plug 10 thereby is secured relative to the panel 22.

On one side of the panel 22, the plug 10 has a plurality of exposed terminals 26 to which individual leads (not shown) of a cable or other electric conductor can be connected by a solder joint or the like. The other side of the plug 10 typically has a corresponding plurality of non-rigid spring-loaded contacts 30 which connect internally through the housing 14 to the terminals 26. The specific means for accomplishing this internal circuitry is of no concern with this invention, since it is old and of conventional design.

A known structure for the contacts 30 is illustrated, each contact including an elongated cylindrical nose end 32 and a shoulder 34, where the smaller nose end 30 fits through an opening 36 on the housing 14, and the larger shoulder fits in the larger housing bore 38. A compression spring 40 in the bore 38 is seated against the shoulder 34 and forces the contact 30 to its outermost axially extended position where shoulder 34 butts up against the transverse wall or annular ledge 42 of the housing surrounding the opening 36.

The mating receptacle 12 has a housing 44 with a plurality of rigid contacts 46 supported therein in similar registry with the contacts 30 of plug 10. The contacts 46 are connected by soldered joints or the like to conventional wire or conductor means (not shown) which are fed internally through the hollow housing 44 to exterior electrical components (not shown). The plug 10 and receptacle 12 typically telescope relative to one another as they are mated, and in this regard, the receptacle 12 has an annular wall 50 which is larger than and telescopes over the cylindrical wall 52 of the housing 14 of plug 10. There further is typically provided in at least one of the walls (shown herein in a groove in wall 50) an O-ring 54 or other form of seal adapted to cooperate in a weathertight sealing relationship with the inner cylindrical wall 52 of the plug 10. The two cylindrical bodies 50 and 52 are adapted thereby to be biased axially relative to one another into a telescoped mating configuration where the contacts 46 and 30 engage one another and establish electrical continuity through the plug and receptacle elements of the quick-disconnect connector.

The plug and receptacle 10 and 12 are secured together relative to one another by bayonet type locks illustrated generally at 56. Such a bayonet type lock includes a plurality of radial pins or projections 58, commonly three being used as illustrated herein in FIGS. 2 and 3 at 120° spacings, which project radially inwardly in receptacle 12 and cooperate in respective J-grooves 60 provided on the cylindrical body of plug 10. In the illustrated embodiment, the pins 58 project radially inwardly from the receptacle housing 44 and are adapted to fit within the outwardly facing J-grooves 60 formed on the cylindrical stem section 18 of the plug housing 14. Each J-groove 60 has an axial recess section 62 and a lateral or transverse recess section 64, and a detent like projection or hump 66 separates the axial recess section from a seating area 68 formed at the remote end of the transverse recess section.

In order to engage such a bayonet locking arrangement 56, the plug and receptacle members 10 and 12 must be forced axially together relative to one another compressing the non-rigid plug contacts 30 in the plug 10 to move the locking pins 58 initially along the axial recesses 62 of the J-grooves until the pins reach the transverse recesses 64, and the plug and receptacle must then be rotated relative to one another to ride the pins over the high detent humps 66 and then position the pins in the seating areas 68. The spring biased contacts 30 permit such relative axial movement of the plug 10 and receptacle 10, while the compression of springs 40, with the contacts 30 and 46 bearing against one another, yieldingly maintains the locking pins 58 snugged in the seating areas 68 of the J-grooves 60.

The specific development to which this invention pertains relates to means provided on the connectors for positively maintaining the engaged bayonet locks 56 engaged. This includes an annular sleeve 70 which is fitted over the housing 44 of the receptacle 12 and cooperates therewith by means of a threaded connection. As illustrated, an annular ring 72 is seated onto the housing 44 of receptacle 12, preferably being staked or secured thereto as by spot welds illustrated schematically at 74, so that it can be considered an integral part of the receptacle housing 44. Formed on the exterior of the ring 72 are helical threads 76, and formed internally of the sleeve 70 are cooperating threads 78. The sleeve 70 thus can be rotated relative to the receptacle housing 44 and thereby moved axially along or relative to the receptacle 12.

In the preferred embodiment illustrated, sleeve 70 is larger than locking nut 24 and thereby can be rotated down until it bottoms against panel 22. When this is done, locking pins 58 cannot be moved from the seating areas 68, as the plug 10 and receptacle 12 must first be biased axially toward one another in order to have the pins 58 clear detent humps 66. The annular sleeve 70 thus threaded onto one of the plug and receptacle members and bottomed against or relative to the opposite mating member positively maintains the connectors locked together without reliance on the contact springs 40 and avoids accidental separation of the plug and receptacle.

In a preferred embodiment, the exterior surface of the sleeve 70 is knurled as at 80 to allow for the ready finger gripping by a person tightening down and/or loosening the sleeve 70.

While it is illustrated the sleeve 70 is larger in diameter than locking nut 24 and thereby completely fits over or encloses the nut, it would be possible to provide the sleeve with a diameter similar to or smaller than the nut so that the sleeve would bottom against the nut itself. Similarly, although sleeve 70 is illustrated herein as cooperating with the larger or exterior cylindrical wall 50 of the telescoped plug and receptacle members, it could as well cooperate with the threaded stem (as along 18) on the housing 14 of the plug 10 and be backed out and bottomed against the end 82 as noted on the annular wall 50 of the housing 44. An important aspect of this invention is that the sleeve threaded on one connector element can be moved to bottom against the other connector element in a manner to hold the bayonet type pins 58 engaged in the seating areas 68, which establishes thereby a positive mechanical securement of the plug and receptacle connector elements to one another even though a spring-actuated bayonet lock arrangement is incorporated.

What is claimed is:

1. For use with a quick-disconnect connector having plug and receptacle members which when locked together in mating relation establish electrical continuity through the connector, cooperating bayonet lock means including at least one J-shaped groove formed in one of the plug and receptacle members, and at least one cooperating pin formed on the other of the plug and receptacle members and adapted to fit into said J-shaped groove, each said J-shaped groove having an axial recess portion and also a transverse recess portion having a seating area separated from the axial recess portion across detent hump means, said pin being adapted to seat against said seating area in the mated condition of the plug and receptacle members, movable spring-loaded contacts on one of said plug and receptacle members engaged and deflected by contacts on the other of said plug and receptacle members when said plug and receptacle members are in mated condition with said spring-loaded contacts serving to bias said pin in seated position in said seating area, the improvement comprising, an annular sleeve element having internal thread means, one of the plug and receptacle members having external thread means for cooperation with the internal thread means of said sleeve element, and the sleeve element being rotatable on one of the plug and receptacle members to move the sleeve axially toward the other of the plug and receptacle members, said sleeve element when bottomed relative to the opposite one of the plug and receptacle members being effective to maintain said pin positively seated in said seating area thereby preventing axial movement of the plug and receptacle members toward one another to provide a releasable positive lock against disengagement of said bayonet lock means.

2. The combination according to claim 1 wherein said one of the plug and receptacle members has an annular wall that telescopes in part over the exterior wall of the opposite member, and wherein the annular sleeve element cooperates by said thread means with the radially outer of the telescoped plug and receptacle members.

3. The combination according to claim 2 where a ring element has external thread means formed thereon, said ring element being fixedly joined to the annular wall of said one of the plug and receptacle members to become a common part therewith, and where said sleeve element cooperates by said thread means with said ring element.

4. The combination according to claim 1 where said sleeve is mounted on said receptacle member.

* * * * *